US005489052A

United States Patent [19]

Blood, Jr.

[11] Patent Number: 5,489,052

[45] Date of Patent: Feb. 6, 1996

[54] BACKPACK FRAME CONVERTIBLE TO A MATTRESS SUPPORTING COT WITH A TENT SUPPORTING STRUCTURE

[76] Inventor: Talmon C. Blood, Jr., 2232 Flint Hill Rd., East Bend, N.C. 27018

[21] Appl. No.: 333,635

[22] Filed: Nov. 3, 1994

[51] Int. Cl.[6] ..... A45F 4/06; A45F 4/04

[52] U.S. Cl. ..... 224/156; 224/154; 135/95; 135/139

[58] Field of Search ..... 224/153, 154, 224/155, 156; 135/95, 96, 134, 137, 139, 140, 141, 142

[56] References Cited

U.S. PATENT DOCUMENTS

| | | | |
|---|---|---|---|
| 2,014,336 | 9/1935 | Marthaler | 135/134 |
| 3,584,322 | 6/1971 | McDougall | 135/96 |
| 3,757,360 | 9/1973 | Wescott | 224/154 |
| 3,822,813 | 7/1974 | Canter | 224/154 |
| 3,848,279 | 11/1974 | Ispen, Jr. | 135/96 |
| 3,995,649 | 12/1976 | Robichaud | 135/139 |
| 4,418,854 | 12/1983 | Genovese | 224/154 |
| 4,852,598 | 8/1989 | Griesenbeck | 135/137 |
| 4,885,812 | 12/1989 | Lindner | 224/154 |
| 4,955,517 | 9/1990 | Maresca | 224/155 |

FOREIGN PATENT DOCUMENTS

| | | | |
|---|---|---|---|
| 1417654 | 10/1965 | France | 135/140 |
| 702097 | 3/1966 | Italy | 135/95 |

*Primary Examiner*—Henry J. Recla
*Assistant Examiner*—Gregory M. Vidovich
*Attorney, Agent, or Firm*—Petree Stockton

[57] ABSTRACT

A backpack frame convertible to a mattress supporting cot with a tent supporting structure includes first and second generally U-shaped tubular frame sections hinged to each other and foldable between a compact position defining a backpack frame configuration and an extended position defining a normally substantially horizontally disposed cot configuration having opposing hollow side members. Each hollow side member has an open end, and the respective open ends are positioned diagonally opposite each other. When disposed in a cot configuration, the cot is supported by a plurality of support members mounted on each side member. A tent support assembly is storable in each hollow side member and extendible from the respective side member open ends to define an obliquely disposed strut and substantially horizontally disposed ridge member superposing the cot. The ridge members are releasably connectible to each other at one end and pivoted at the other end to the respective struts. Each of the tent support assemblies includes a strut support slideably retained in the respective hollow side members.

20 Claims, 4 Drawing Sheets

BACKPACK FRAME CONVERTIBLE TO A MATTRESS SUPPORTING COT WITH A TENT SUPPORTING STRUCTURE

BACKGROUND OF THE INVENTION

1. Field of the Invention

The present invention relates to camping equipment and more particularly to a new and improved backpack frame which is convertible to a camp cot having a structure for supporting a tent.

2. Description of the Prior Art

Various types of backpack frames which can be converted into a cot frame or a combination cot and tent frame are well known in the art. Generally, such prior art convertible backpacks have proven unsatisfactory because they are too flimsy to support any substantial weight as a sleeping cot, too heavy to be readily transportable as a backpack, uncomfortable when used either as a backpack or a sleeping cot, and too complicated and expensive to make and use.

There is a current need to provide a backpack frame which can be converted to a combination sleeping cot and tent supporting frame that can be comfortably carried on the back as a backpack, can be easily and quickly converted to a sleeping cot having a taut, level sleeping surface which is sufficiently long and wide to accommodate an adult comfortably, and which is formed as a unit composed of connected parts, while retaining the simplicity and cost associated with the design and manufacture of such convertible backpack frames within the same range as presently experienced with prior art convertible backpack frames.

While prior art convertible backpack frames are disclosed, for example, in U.S. Pat. Nos. 3,158,299; 3,620,428; 3,619,827; 3,757,360; 3,828,992; 3,846,855; 3,912,138; 3,971,495; 5,056,857; 4,511,071; 4,885,812; 4,914,768; and 4,947,498, none of the convertible backpack frames of the types disclosed addresses this need.

The present invention addresses this need and provides a unitary backpack frame which is formed as a unit composed of connected parts that can be converted to a combination sleeping cot and tent supporting frame, which can be comfortably carried on the back as a backpack, and which can be easily and quickly converted to a sleeping cot having a taut, level sleeping surface of sufficient length and width to comfortably accommodate an adult.

SUMMARY OF THE INVENTION

The general purpose of the present invention, which will be described in greater detail, is to provide a new and improved backpack frame which is convertible to a camp cot having a structure for supporting a tent that has all, and more, of the advantages of the prior art and none of the disadvantages.

To attain this purpose, representative embodiments of the present invention are illustrated in the drawings. The convertible backpack frame of the present invention makes use of a unitary frame which is formed as a unit composed of connected parts including first and second frame sections which are hinged to each other. The frame sections are foldable between a compact position defining a backpack frame configuration and an extended position defining a cot configuration with opposing hollow side members. Each of the hollow side members has an open end, and the respective hollow side member open ends are disposed diagonally opposite each other. The side members are also each provided with a plurality of support members.

A tent support assembly is storable in each hollow side member as a connected part of the unit. Each of the tent support assemblies is extendable from a respective side member open end to define an obliquely disposed strut and a substantially horizontally disposed ridge member superposing the cot. The ridge members each have opposing ends and are connectable to each other at one of their respective opposing ends, and the ridge members are pivoted at the other of their respective opposing ends to the respective struts. Each tent support assembly also includes a strut support slideably retained in the respective hollow side members, and each strut is pivoted at one of its respective opposing ends to the respective strut supports.

The strut supports are each provided with a slotted hole, and each strut includes a strut connector portion which is pivotable on a pivot pin slidable in the respective strut support slotted holes. The side member open ends are each provided with a slot which is configured to receive one of the strut connector portions in an obliquely disposed position of the respective struts. The struts also include a channel formed proximate the end of each strut opposite the strut end that is pivoted on the strut support. The respective ridge members are pivotable between a substantially horizontally disposed ridge member position and a folded position, and each of the channels is configured to receive one of the ridge members in the folded position.

The struts are each pivotable on the respective slidable pivot pins between the obliquely disposed strut position and a substantially horizontally disposed position. In the horizontally disposed position, the struts are receivable in the respective hollow side members in the folded position of the ridge member for storage. Each of the ridge members is tubular, and each includes at least two telescoping ridge member sections which are extendable in order to connect the ridge members together in a horizontally disposed position superposing the cot. The telescoping ridge member sections are also retractable for pivoting the respective ridge members to the folded position for storage. The struts also each include a tubular portion near one of the respective strut ends, and the strut connector portions are slideably retained by the respective tubular strut portions. Each ridge members also includes a locking pin assembly for locking the telescoping ridge member sections in the extended position.

The frame sections forming the unitary frame of the present invention are each configured as generally U-shaped tubular members, including a bight portion extending between opposite side members, and a plurality of cross pieces which also extend between the side members. The respective bight portions and each of the cross pieces include a slidable member which enables expansion of the respective frame sections in a lateral direction from the backpack configuration to the sleeping cot configuration, and the bight portions and cross pieces each have an arcuate shape.

Each support member provided on the respective side members is affixed to a ring which is rotatable between a position of the support member disposed inward of the respective frame sections and a downwardly depending position of the support member relative to the respective side members. The rings are each provided with a locking pin assembly for locking the ring in the downwardly depending position of the support member. Preferably, a mattress is provided with a plurality of spaced connector members, for example spaced loops affixed to lateral edges of the mattress, which are releaseably engageable by the respective support members. The respective support members may also include threaded foot sections for adjusting the vertical height of the support members to level the cot. Additionally, a foldable tent cover may be provided which can be supported on and secured to the tent support assembly and frame sections by means of an elastic band or drawstring in the bottom edge of the foldable tent.

This outline focuses on the more important features of the invention in order that a detailed description which follows may be better understood and in order that the present contribution to the art may be better appreciated. There are, of course, additional features of the invention that will be described hereinafter and which will form the subject matter of the claims appended hereto. It is to be understood that the invention is not limited in its application to the details of the construction and to the arrangement of the components set forth in the following description and drawings. The invention is capable of other embodiments and of being practiced and being carried out in various ways.

It is to be further understood that the phraseology and terminology employed herein are for the purpose of description and are not to be regarded as limiting. Those skilled in the art will appreciate that the conception upon which this disclosure is based may readily be utilized as a basis for designing the structures, methods and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved backpack frame which is convertible to a camp cot having a structure for supporting a tent which has all the advantages, and more, of prior art convertible backpack frames and none of the disadvantages.

It is another object of the present invention to provide a new and improved design for a convertible backpack frame which is more reliable and functional than those presently available.

Yet another object of the present invention is to provide a convertible backpack frame which is sturdy and capable of supporting substantial weight when used as a sleeping cot, while at the same time being light weight and easily transportable as a backpack frame.

Still another object of the present invention is to provide a convertible backpack frame which conforms comfortably to the shape of a person's back when folded into a compact position for use as a backpack, yet can be unfolded into an extended position and expanded laterally for use as a sleeping cot to accommodate a full grown adult comfortably.

A further object of the present invention is to provide a convertible backpack frame which is formed as a unit of connected parts which cannot be misplaced or lost.

These, together with other objects of the present invention, along with the various features of novelty which characterize the invention, are pointed out with particularity in the claims annexed to and forming a part of this disclosure. For a better understanding of the invention, its operating advantages, and the specific objects attained by its uses, reference should be made to the accompanying drawings in which like characters of reference designate like parts throughout the several views.

BRIEF DESCRIPTION OF THE DRAWINGS

The invention will be better understood and objects other than those set forth above will become apparent when consideration is given to the following detailed description. Such description makes reference to the annexed drawings wherein.

DESCRIPTION OF THE PREFERRED EMBODIMENT

Figure 1:
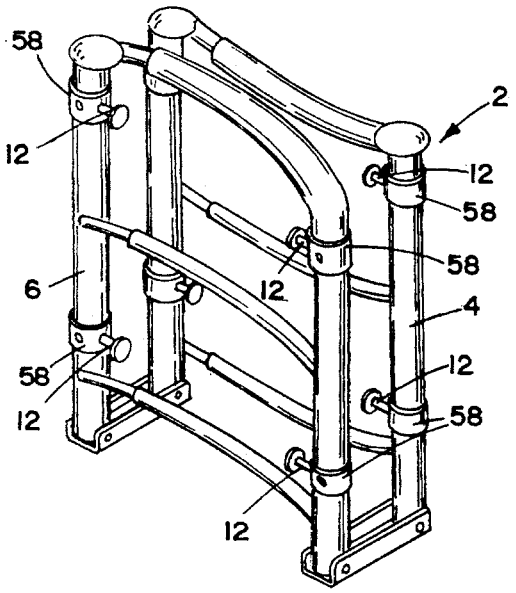
FIG. 1 is a perspective view of the convertible backpack frame of the present invention in a compact position defining a backpack frame.
Figure 2:
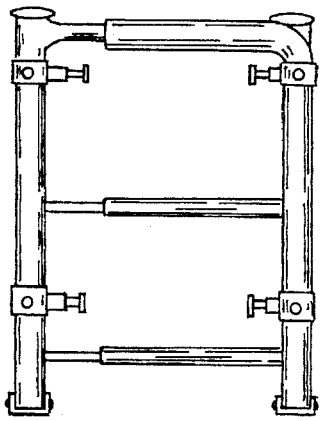
FIG. 2 is a front elevational view of the convertible backpack frame shown in FIG. 1.
Figure 3:
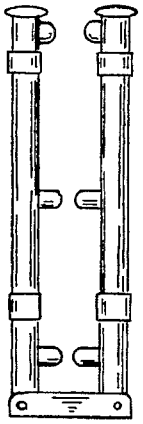
FIG. 3 is a side elevational view of the convertible backpack frame shown in FIGS. 1 and 2.
Figure 4:
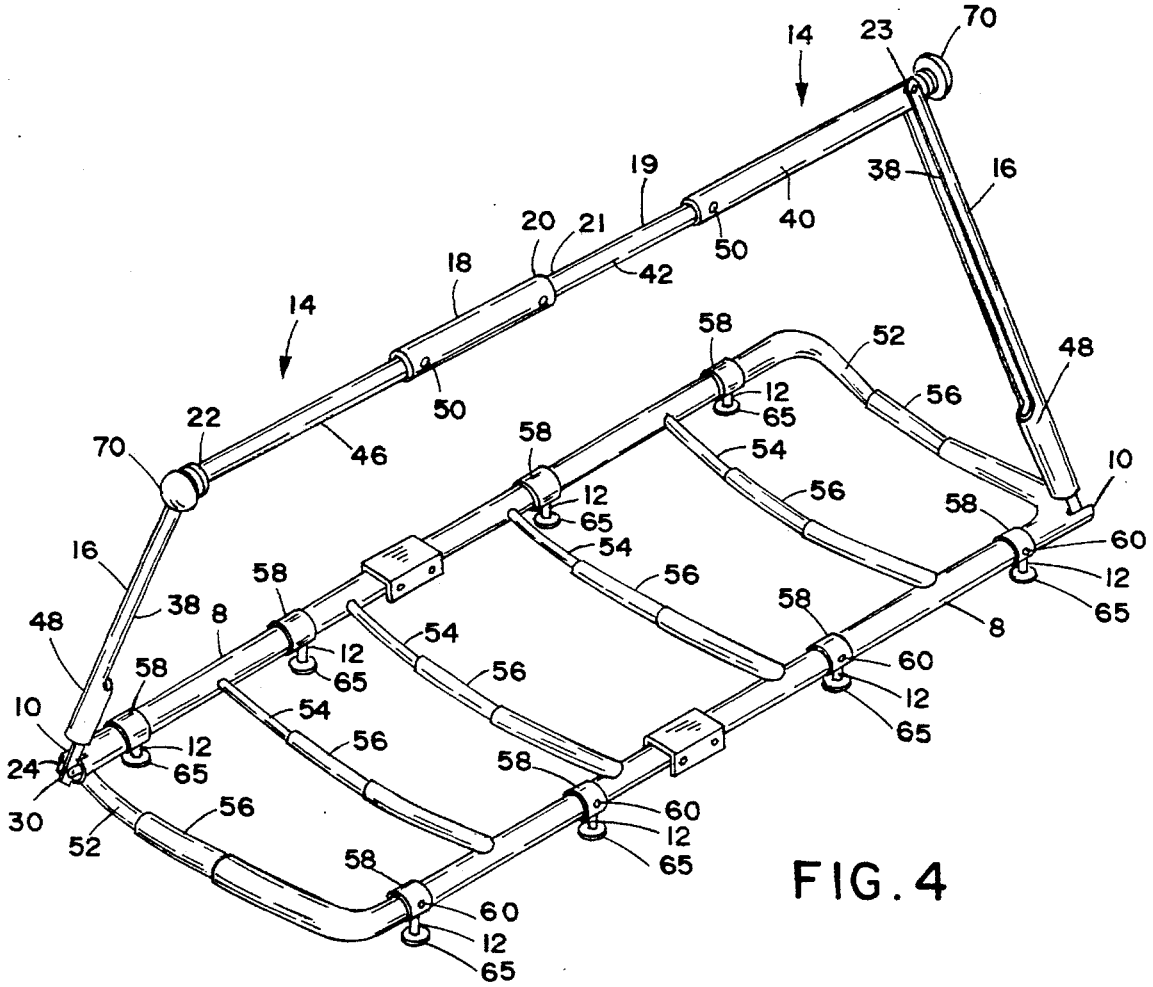
FIG. 4 is a perspective view of the convertible backpack frame of the present invention in an extended position defining a cot configuration and tent support assembly.
Figure 5:
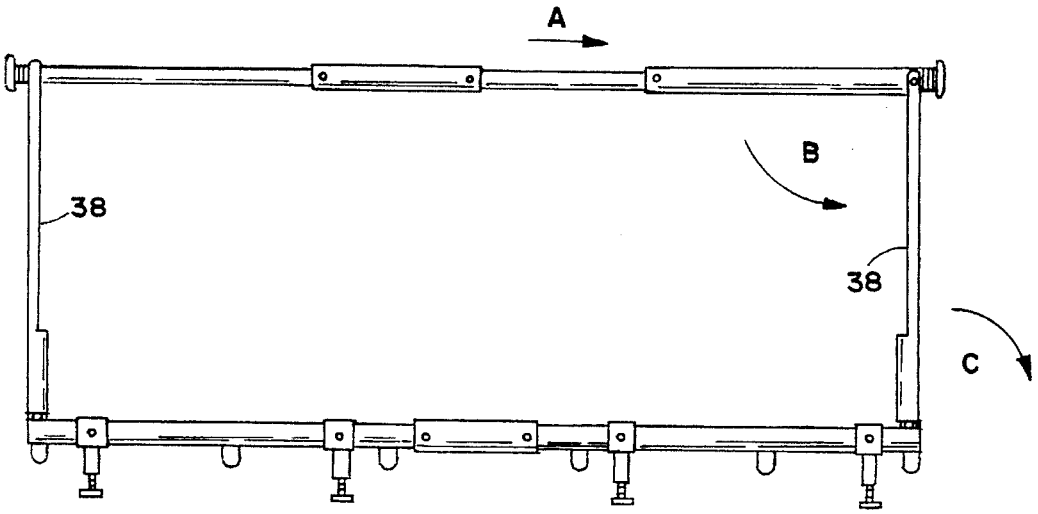
FIG. 5 is a side elevational view of the convertible backpack frame in the position as shown in FIG. 4.
Figure 6:
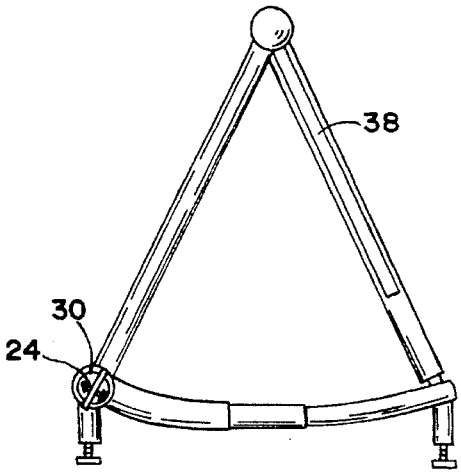
FIG. 6 is an end elevational view of the convertible backpack frame in the position as shown in FIGS. 4 and 5.

Referring now to the drawings, and specifically to FIG. 1, the convertible backpack frame shown generally as 2 includes first and second frame sections 4, 6 which are hinged together. Backpack frame 2 is foldable between a compact position defining a backpack frame as shown in FIG. 1 and an extended position defining a sleeping cot configuration as shown in FIG. 4 having opposing hollow side members 8. Each of side members 8 has and open end 10 which are disposed diagonally opposite each other. Side members 8 are also each provided with a plurality of support members 12.

Figure 8:
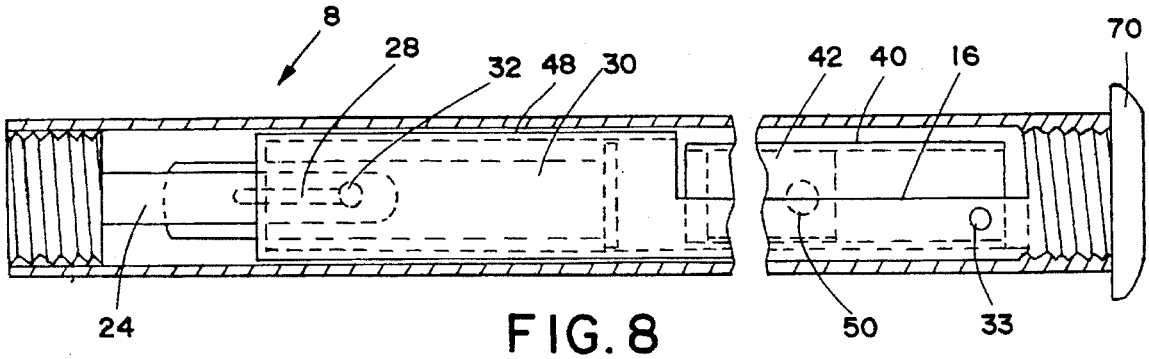
FIG. 8 is an enlarged partial side sectional view of one of the backpack frame side members of the convertible backpack frame of the present invention.
Figure 9:
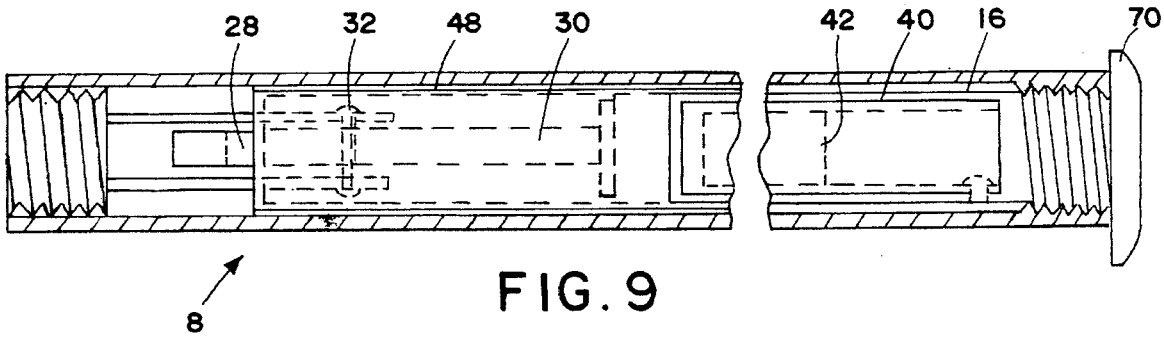
FIG. 9 is an enlarged partial top sectional view of the backpack frame side member shown in FIG. 8.
Figure 10:
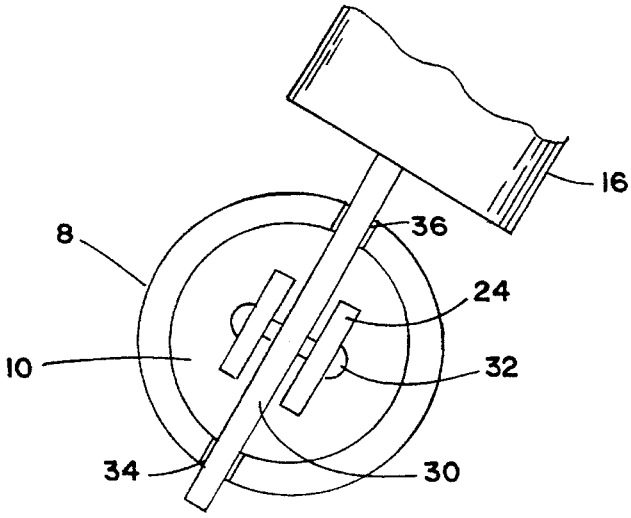
FIG. 10 is and enlarged partial view of one of the open ends of the backpack frame side member shown in FIGS. 8 and 9.

A tent support assembly shown generally as 14 in FIG. 4 is storable in each hollow side member 8 as shown in FIG. 8. Tent support assemblies 14 are each extendable from respective side member open ends 10 to define an obliquely disposed strut 16 and substantially horizontally disposed ridge members 18, 19 superposing the cot as shown in FIG. 4. Ridge members 18, 19 are connected to each other at ridge member ends 20, 21, and each of ridge members 18, 19 is pivoted at its opposite end 22, 23 to one of struts 16. Tent support assemblies 14 also each include a strut support 24 slideably retained in each of hollow side members 8 as shown in FIGS. 8 and 10, and each of struts 16 includes a strut connector portion 30 which is pivoted to a respective strut support 24.

Referring to FIG. 8, a slotted hole 28 is provided in each of strut connector portions 30, and each strut connector portion 30 is pivotable on a pivot pin 32 of strut support 24.

Figure 7:
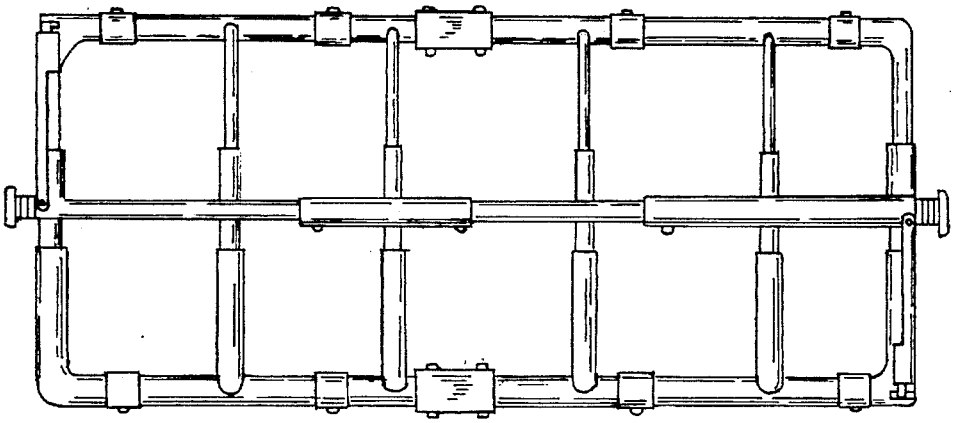
FIG. 7 is a plan view of the convertible backpack frame in the position as shown in FIGS. 4 through 6.

The respective strut support slotted holes 28 are slideable on respective pivot pins 32. Side member open ends 10 are each provided with opposing slots 34, 36 which are configured to receive one of the strut connector portions 30 in an obliquely disposed position of respective struts 16. Each of struts 16 also includes a channel 38 formed proximate the end of each strut 16 opposite strut connector portion 30. The respective ridge members 18, 19 are pivotable on pivot pins 31, 33 (See FIG. 7) between a substantially horizontally disposed ridge member position superposing the cot as shown in FIG. 4 and a folded position in which respective ridge members 18, 19 are received by and nest within respective channels 38.

Struts 16 are each pivotable on respective pivot pins 32 between the obliquely disposed upright strut position as shown in FIG. 4 and a horizontally disposed position. In the horizontally disposed position, with ridge members 18, 19 in the folded position, struts 16 are receivable in respective hollow side members 8 through side member open ends 10 for storage, as shown in FIG. 8. Each of ridge members 18, 19 is tubular, and each includes at least two telescoping ridge member sections 40, 42 and 44, 46 which are extendable in order to connect the ridge members 18, 19 together in a horizontally disposed position superposing the cot. Telescoping ridge member sections 40, 42 and 44, 46 are also retractable in order for ridge members 18, 19 to fit within respective channels 38 in the folded position of ridge members 18, 19. Each strut 16 also includes a tubular portion 48 proximate strut connector portion 30, and strut connector portions 30 are slideably retained by the respective tubular strut portions 48. Each ridge member 18, 19 also includes a locking pin assembly 50 for locking telescoping ridge member sections 40, 42 and 44, 46 in the extended position.

Frame sections 4, 6 forming the unitary frame of the present invention are each configured as generally U-shaped tubular members including a bight portion 52 extending between opposite side members 8, and a plurality of cross-pieces 54 which also extend between side members 8. The respective bight portions 52 and each of cross-pieces 54 include slidable members 56 which enables expansion of respective frame sections 4, 6 in a lateral direction by pulling side members 8 in opposite directions when backpack frame 2 is converted from a folded compact position as shown in FIG. 1 to an extended position for use as a sleeping cot as shown in FIG. 4. Bight portions 52 and cross-pieces 54 are arcuately shaped to conform generally to the shape of a person's back for use as a backpack.

Figure 12:
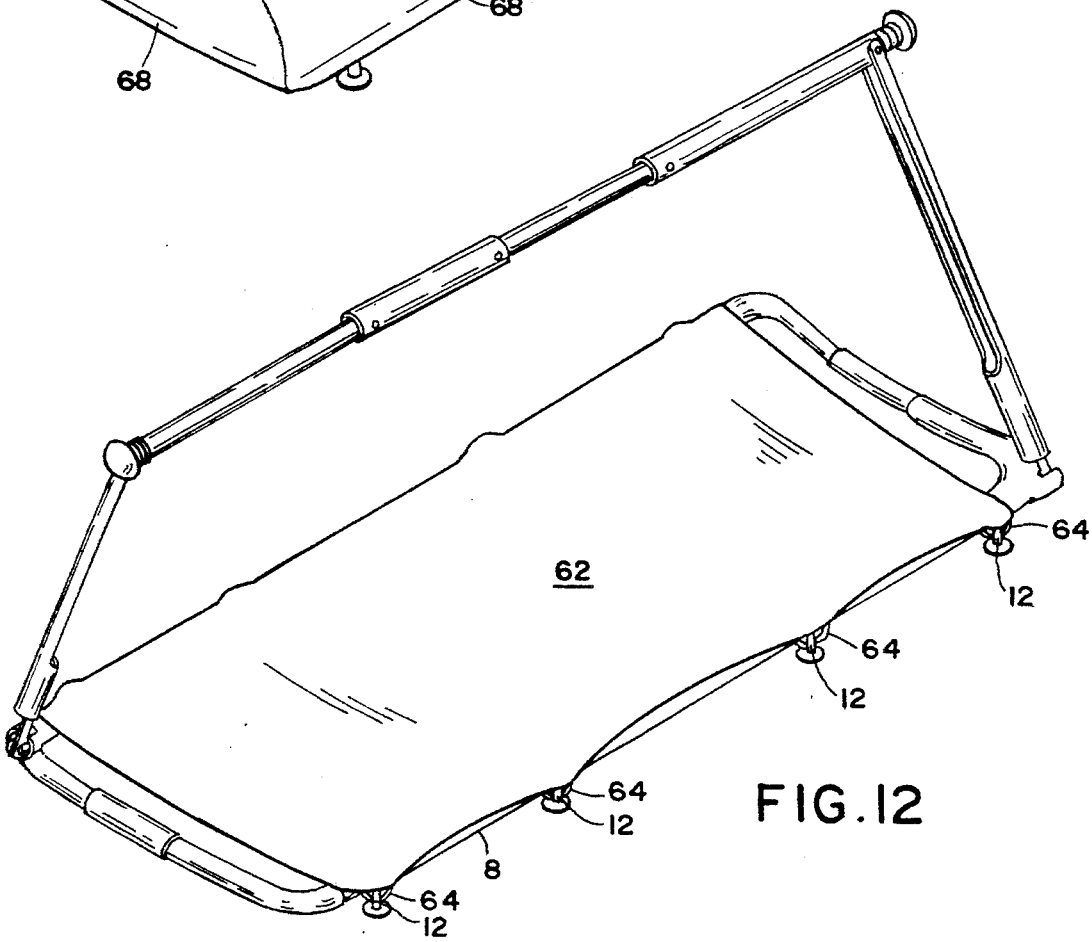
FIG. 12 is a perspective view of the convertible backpack frame in the position shown in FIGS. 4 through 7 with a mattress attached.

Each of support members 12 provided on respective side members 8 is affixed to a ring 58 rotatable on side members 8 between a position of support members 12 disposed inward of frame sections 4, 6 as shown in FIG. 1 and a downwardly depending position of support members 12 as shown in FIG. 4. Rings 58 are each provided with a locking pin assembly 60 for locking respective rings 58 in the downwardly depending position of respective support members 12. A mattress 62 has a plurality of spaced connector members or loops 64 and is attached to side members 8 by stretching mattress 62 over side members 8 and looping connector members 64 around support members 12 as shown in FIG. 12. Then support members 12 are rotated to the downwardly depending position which stretches mattress 62 over side members 8 to a taut condition of mattress 62. In such condition, mattress 62 is suspended above cross-pieces 54, and comfortably supports the weight of a sleeping person without resting on cross-pieces 54.

Figure 11:
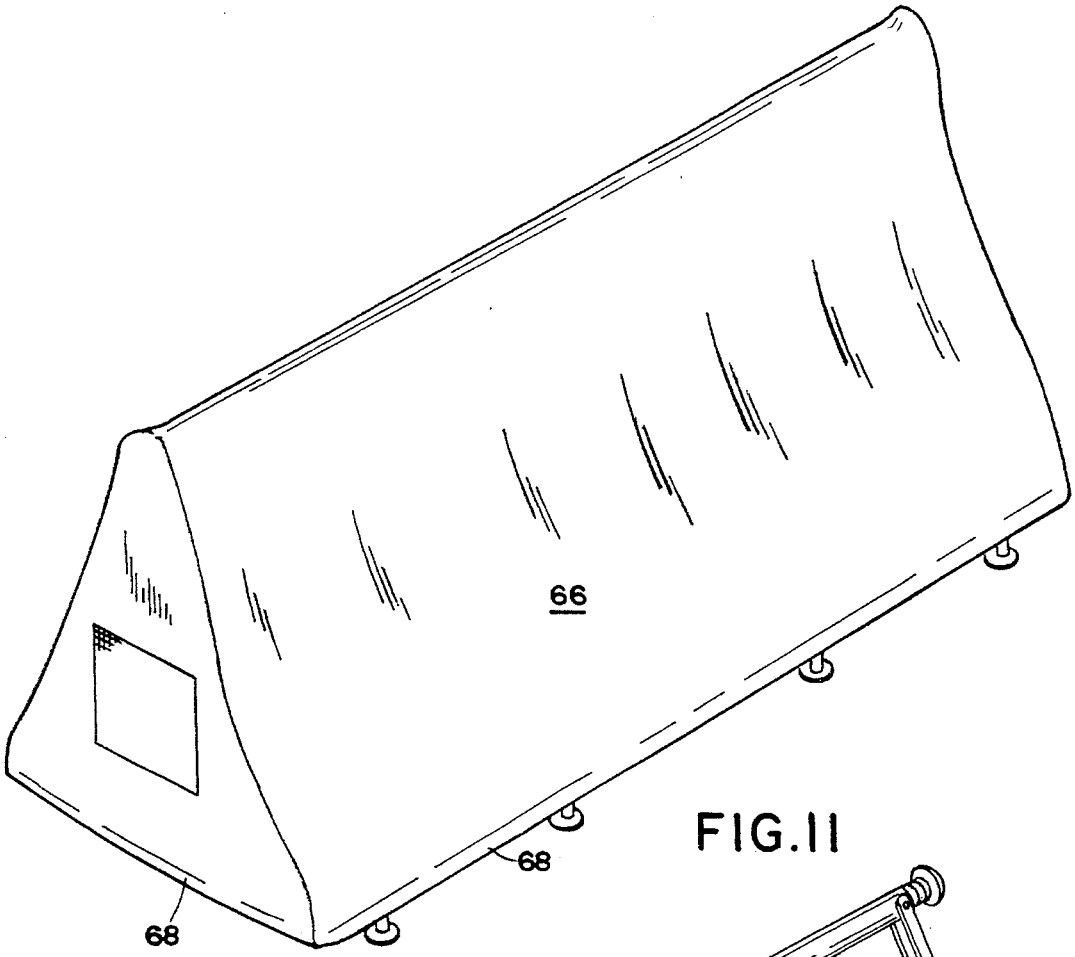
FIG. 11 is a perspective view of the convertible backpack frame in the position shown in FIGS. 4 through 7 supporting a tent cover.

The respective support members 12 may also include threaded foot sections 65 for adjusting the support member vertical height. Additionally, as shown in FIG. 11, a foldable tent cover 66 may be provided which is supported on tent support assembly 14 and secured to side members 8 and bight portions 52 by an elastic band or drawstring in the bottom edge 68 of foldable tent cover 66.

Preferably, tent support assemblies 14 include respective ridge members 18, 19. Alternatively, ridge members 18, 19 may be omitted altogether, in which case, foldable tent cover 66 can be adequately supported by struts 16, which are securely retained in an obliquely disposed position when respective strut connector portions 30 are received in respective slots 34, 36. In such obliquely disposed position of each of struts 16, respective strut supports 24, pivot pins 32, and strut connector portions 30 cooperate to prevent dislodgement of respective connector portions 30 from slots 34, 36 and to prevent movement of respective struts 16 from the oblique position.

The entire convertible backpack frame of the present invention is formed of a unit composed of connected parts with the exception of foldable tent cover 66. Ridge members 18, 19, are pivoted at ends 22 to struts 16 and foldable into channels 38. Struts 16 are pivoted to strut supports 24 and, with ridge members 18, 19 folded and received in channels 38, are pivotable to a horizontal position and received in tubular side members 8 through open ends 10 for storage and secured by threaded caps 70.

Obviously, any number of materials may be used to form the backpack frame and its components described herein, and exceptional success has been experienced by the use of aluminum and rigid plastic material, although other materials may be utilized, any light weight sheet material such as nylon or canvas may be used for the tent cover and mattress.

With respect to the descriptions set forth above, optimum dimensional relationship for the parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principles of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A unitary backpack frame convertible to a mattress supporting cot with a tent supporting structure comprising:

first and second frame sections hinged to each other and foldable between a compact position defining a backpack frame configuration and an extended position defining a normally substantially horizontally disposed cot configuration, each of said frame sections including a hollow side member which oppose one another in a diagonal relation, each hollow side member having on open end;

a plurality of support members mounted on each side member:

a tent support assembly storable in each hollow side member and extendable from the respective side member open ends to define a strut extending obliquely upward relative to the respective frame sections;

the strut of each of the tent support assemblies being pivoted on a strut support slideably retained in each of said hollow side members; and each of said tent support assemblies is extendable to define a ridge member disposed in a substantially horizontal position superposing said cot, each of the ridge members having opposing ends and being releaseably connectable to each other at one of the respective ridge member ends and pivoted at the other of the respective ridge member ends to a respective one of said struts.

2. The backpack frame as claimed in claim 1, each of said struts having opposing ends and being pivoted at one of the opposing strut ends to the respective strut supports.

3. The backpack frame as claimed in claim 2, each of said strut supports having portions at said one opposing strut end defining a slotted hole, and each of said struts having a strut connector portion pivotable on a pivot pin slidable in the respective strut support slotted holes.

4. The backpack frame as claimed in claim 3, each of said side member open ends having portions defining a slot configured to receive said strut connector portion in said obliquely disposed position of the respective struts.

5. The backpack frame as claimed in claim 4, each of said struts including portions defining a channel proximate the other of said respective opposing strut ends configured to receive said respective ridge members in a folded position, each of said ridge members being pivotable between said substantially horizontally disposed ridge member position and said folded position of said ridge member.

6. The backpack frame as claimed in claim 5, each of said struts being pivotable on said pivot pin between said obliquely disposed position and a substantially horizontally disposed position and slideably receivable in said horizontally disposed position by said respective hollow side members when said respective ridge members are in said folded position.

7. The backpack frame as claimed in claim 6, wherein each of said ridge members are tubular and each includes at least two telescoping ridge member sections extendable for connection of said ridge members between said one of said respective ridge member opposing ends in said horizontally disposed ridge member position and retractable for pivoting the respective ridge members to said folded position.

8. The backpack frame as claimed in claim 7, each of said struts including a tubular strut portion proximate said one opposing strut end, said strut connector portion being slideably retained in said tubular strut portion.

9. The backpack frame as claimed in claim 8, each of said ridge members including means for locking said telescoping ridge member sections in said extended position.

10. The backpack frame as claimed in claim 9, each of said frame sections comprising a generally U-shaped tubular member including a bight portion extending between interconnecting opposing side members.

11. The backpack frame as claimed in claim 10, each of said frame sections further comprising a plurality of cross pieces extending between and interconnecting said side members.

12. The backpack frame as claimed in claim 11, each of said frame section bight portions and each of said frame section cross pieces including a telescoping slidable member enabling expansion of said respective frame sections in a lateral direction from said backpack configuration to said cot configuration.

13. The backpack frame as claimed in claim 12, wherein each of said frame section bight portions and each of said frame section cross pieces are arcuate.

14. The backpack frame as claimed in claim 13, wherein each of said support members is rotatably mounted and rotatable on said side members between a position disposed inward of said respective frame sections and a downwardly depending position relative to said respective side members.

15. The backpack frame as claimed in claim 14, wherein each of said support members is affixed to a ring rotatably mounted on said respective side members and further comprising means for locking the respective rotatable rings in said downwardly depending position of said respective support members.

16. The backpack frame as claimed in claim 15, further comprising a mattress having a plurality of spaced connector members, each of the connector members being releaseably engageable by a respective support member.

17. The backpack frame as claimed in claim 16, wherein said rotatable ring locking means comprises a locking pin associated with each of said rotatable rings.

18. The backpack frame as claimed in claim 17, each of said support members including leveling means.

19. The backpack frame as claimed in claim 18, said leveling means comprising first and second threadedly connected support member sections for vertical height adjustment of said respective support members.

20. The backpack frame as claimed in claim 19, further comprising a foldable tent cover having a top section connecting opposing end sections, each of said top section and end sections having a bottom edge provided with an elastic band or drawstring, supportable by said tent support assembly and releaseably connectable to said first and second frame sections.

* * * * *